United States Patent [19]

Sako

[11] Patent Number: 4,652,847

[45] Date of Patent: Mar. 24, 1987

[54] THERMAL-TYPE OVERLOAD RELAY

[75] Inventor: Yuji Sako, Nagoya, Japan

[73] Assignee: Mitsubishi Denki Kabushiki Kaisha, Tokyo, Japan

[21] Appl. No.: 843,284

[22] Filed: Mar. 24, 1986

[30] Foreign Application Priority Data

Mar. 26, 1985 [JP] Japan ..... 60-42362[U]

[51] Int. Cl.[4] ..... H01H 71/16; H01H 37/70

[52] U.S. Cl. ..... 337/49; 337/45

[58] Field of Search ..... 337/49, 45, 48

[56] References Cited

U.S. PATENT DOCUMENTS 3,638,158 1/1972 Thorne ..... 337/49

3,792,401 2/1974 Anderson ..... 337/49

3,800,260 3/1974 Woodger ..... 337/49

*Primary Examiner*—Harold Broome

*Attorney, Agent, or Firm*—Oblon, Fisher, Spivak, McClelland & Maier

[57] ABSTRACT

In the thermal-type overload relay such a construction that a bimetallic strip deforms due to heat produced by an excessive amount of current to actuate a normally closed movable contact which constitutes a normally closed contact, and an operating rod is moved in a predetermined direction to thereby close a normally open contact comprising a normally open fixed contact and a normally open movable contact, there is provided a reset rod moving in the direction perpendicular to the operating rod so that when the reset rod is moved in the direction perpendicular to the operating rod, the normally open fixed contact are caused to move toward the normally open movable contact, whereby the normally open contact is returned to the original position, and the normally closed contact is also returned to the original position by a returning movement of the normally closed movable contact due to the returning movement of the operating rod.

4 Claims, 8 Drawing Figures

THERMAL-TYPE OVERLOAD RELAY

The present invention relates to a thermal-type overload relay to be inserted in the main power source circuit of, for instance, an induction motor for the purpose of protecting the induction motor from burning out due to overload. More particularly, it relates to an improvement in a contact operating mechanism of the relay.

FIG. 1 is a front view of the thermal-type overload relay of an improved type as shown, for instance, in U.S. Pat. Application No. 741,920; FIG. 2 is a cross-sectional view taken along a line C—C FIG. 3 is a perspective view showing a movable contact, and FIG. 4 is a perspective view showing an operating lever.

In FIGS. 1 to 4, a reference numeral 1 designates a housing made of a plastic material; a numeral 3 designates a bimetallic strip provided in each phase (all of three phases if a three phase a.c. machine is used) of the line connected to the main power source circuit of an induction motor, for instance. The bimetallic strip is fixed to a fixed terminal (not shown) attached to the housing so as to be connected with an external line. The bimetallic strip is heated by a heater 4 through which a main circuit current flows and is deformed in a curved form as shown by dotted lines.

A reference numeral 8 denotes a shifter for transmitting movement of the bimetallic strip 3 upon its deformation due to heating. The shifter 8 is connected to the end portion of each of the bimetallic strips 3, and one end of the shifter is adapted to push the lower end portion of a temperature compensating bimetallic strip 9. A reference numeral 10 denotes an operating lever to which the upper portion of the temperature compensating bimetallic strip 9 is fixed. The operating lever 10 has its lower portion supported by a shaft 11 passing through apertures **10*b* so as to be rotatably mounted on the shaft 11. The two ends of the shaft 11 are supported by a lever support 12. The lever support 12 has an L-shaped inner portion 12*a* which is supported by an edge portion 1*a* of the housing 1. The lever support 12 further has a first tongue portion 12*b* extending from one side of the L-shaped inner portion 12*a* and being in contact with an adjusting screw 13, and a second tongue portion 12*c* below the L-shaped inner portion 12*a*, which is urged in the leftward direction in FIG. 1 by a plate spring 14. When an adjusting knob 15, mounted on the upper portion of the adjusting screw 13, is rotated, the lever support 12 is rotated clockwisely or counterclockwisely around the edge portion 1*a* in FIG. 1, and thus, in dependence on the direction of rotation of the adjusting screw 13, the shaft 11 is moved to the left or right in FIG. 1**, thereby adjusting the operating current of the relay.

A reference numeral 16 denotes a movable contact made of a thin metal plate having resiliency. As shown in FIG. 3, the movable contact 16 is formed by a punching operation to have an inner beam portion **16*a* and an outer beam portion 16*b*. A ⊏-shaped metal plate spring 17 is placed across the end point of the inner beam portion 16*a* and the outer beam portion 16*b* so that the both ends of the spring are resiliently engaged with the outer and inner beam portions. The contact portion 16*c* of the movable contact 16 is disposed opposite a normally closed fixed terminal 18 thereby to form a normally closed contact. The lower end portion 16*e* of the movable contact 16 is fixed to a normally closed movable side terminal 19. The normally closed movable side terminal 19 is fixed to the housing 1 by a fastening screw. The inner beam portion 16*a* of the movable contact 16 is vertically inserted into a substantially T-shaped hole 10*a* at the end portion of the operating lever 10, as shown in FIG. 4. The upper end portion 16*f* of the movable contact 16 is engaged with a groove 21*a* formed at the left end portion of the operating rod 21. The operating rod 21 is supported by the housing 1 so as to be movable leftwardly and rightwardly in the horizontal direction in FIG. 1**.

Reference numerals 22 and 23 denote normally open terminals; 24, a normally open fixed contact; and 25, a normally open movable contact which comes in contact with the normally open fixed contact. The end portion of the normally open movable contact 25 is inserted into a hole **21*d* having a T-shape, when looked from the side direction, so as to be in contact with projections 21*b* and 21*c* of the operating rod 21**.

A reference numeral 26 indicates a reset rod supported by the housing 1 in such a manner as to be movable in the upward and downward directions in FIG. 1. The reset rod 26 is normally urged in the upward direction by a spring 27. Further, a slanting surface **26*a* located at the lower portion of the reset rod 26 is disposed opposite to a vertically angled portion 21*e* formed at the right end part of the operating rod 21**.

The slanting surface **26*a* pushes the angled portion 21*e* when the operating rod 21 is brought into a tripping state, namely, it is moved in the rightward direction. A numeral 21*f* designates a projection formed integrally with the operating rod 21, which extends in a window provided at the upper surface of the housing 1 so as to be operable through the window 30**.

The operation of the thermal-type overload relay thus constructed will be explained hereinafter. The bimetallic strip 3 is deformed, as shown by dotted lines in FIG. 1, due to heat produced by the main circuit current flowing into the heater 4. That is, when the induction motor becomes an overload condition, the main circuit increases. The resulting increase in the main circuit current causes further deformation of the bimetallic strip 3 thereby pushing the shifter 8 in the leftward direction in FIG. 1. By this movement, the connected assembly composed of the temperature compensating bimetallic strip 9 and the operating lever 10 rotates around the shaft 11 in the clockwise direction, and the movable contact 16 which is inserted in the T-shaped hole **10*a* formed at the end of the operating lever 10 comes in contact with the periphery of the T-shaped hole 10*a*. Accordingly, the inner beam portion 16*a* of the movable contact 16 is also moved in the rightward direction. Due to the movement of the inner beam portion 16*a*, when the movable contact 16 passes a dead center position at which the spring force of the ⊏-shaped plate spring 17 is balanced by the force tending to move the movable contact 16 towards its initial position, the outer beam portion 16*b* and the inner beam portion 16*a* snap in the leftward and rightward directions in FIG. 1, respectively. Therefore, the normally closed contact which has maintained electrical conduction by the contact of the contact portion 16*c* to the normally closed fixed contact 18, is opened. Then, the operating rod 21 is pulled at the end portion 16*f* of the outer beam portion to thereby be moved leftwardly in FIG. 1, and the normally open movable contact 25 is moved in the leftward direction by the projection 21*c*. Therefore, the normally open movable contact 25 makes electrical connection with the normally open fixed contact 24**, thereby making the normally open contact closed.

By connecting the normally open contact in series with the electromagnetic coil circuit of an electromagnetic contactor (not shown) used for switching the mian circuit current, the main circuit is automatically interrupted when the induction motor becomes overload condition whereby the mortor is protected from overload. Further, if there is provided an alarm buzzer (not shown), alarm light (not shown), or the like connected in series with the normally open contat, the overload state can be indicated to the operator.

In order to return the bimetallic strip 3, normally open contact and the normally closed contact to their initial states after the main circuit current has been interrupted, the reset rod 26 is manually depresesed downwardly in FIG. 1. By this movement of the reset rod 26, the slanted surface 26*a* of the reset rod 26 pushes the angled portion 21*e* of the operating rod 21 in the rightward direction, whereupon the operating rod and the external beam portion 16*b* of the movable contact 16 are moved rightwardly, as a result of which the movable contact 16 passes the dead center position and snaps back to the state shown in FIG. 1.

In the case where no current is being applied to the main circuit and it is desired to test the circuit by actuating the contact of the thermal-type overload relay, this may be done by manually moving the external projection 21*f* of the operating rod 21 in the leftward direction in FIG. 1, thereby forcibly turning the movable contact 16. It is to be noted that, with the construction described above, the ON and OFF states of the relay can be discriminated externally through the window 30 by the position of the external projection 21*f*.

In the above-mentioned improved thermal-type overload relay, pressure at the contacting point in the normally open contact is determined by a spring force which is given by the quantity of deflection of the normaly open fixed contact 24 after the normally open movable contact 25 is brought into contact with the normally open fixed contact 24. Accordingly, the pressure at the contacting point increases as the quantity of movement of the operating rod 21 in the leftward direction becomes large with the result that good condition can be provided for the purpose of maintaining reliability of the contact.

Since the proposed thermal-type overload relay is constructed as above-mentioned, modification of the relay into a thermal-type overload relay of a type in which the contact is automatically returned can be realized by keeping a reset rod 26 in a depressed state as shown in FIG. 1. In this case, however, the quantity of displacement of the operating rod 21 in the leftward direction is determined by a contact point of the slanting surface 26*a* to the angled portion 21*e* . Namely, the quantity of displacement of the operating rod 21 is restricted. Accordingly, the quantity of displacement of the operating rod is small in comparison with that of an ordinary used manually returning thermal-type overload relay, with the consequence that the contact pressure of the normally open contact is small.

In the thermal-type overload relay of a manually returning type, a pressure of contact changes due to deformation of the normally open fixed contact 24 in the leftward and rightward directions. Especially, when the normally open fixed contact is deformed in the leftward direction, a pressure of contact decreases in the same manner as the above-mentioned automatic type relay. Accordingly, reliability in the contact decreases.

It is an object of the present invention to provide a thermal-type overload relay improving reliability of contact by properly maintaining pressrue of contact of a normally open fixed contact and a normally open movable contact.

The foregoing and the other objects of the present invention have been attained by providing a thermal-type overload relay comprising a bimetallic strip to be bent to a predetermined position due to heat caused by an excessive amount of current, a normally closed movable contact made of a thin resilient metal plate and having an inner beam portion and an outer beam portion, a pushing plate spring placed across said inner and outer beam portions, and a fixed terminal opposing the normally closed movable contact, in which the normally closed contact undergoes a returning movement by transmitting the movement of the bimetallic strip to the inner beam portion to thereby open a normally closed contact comprising a contact portion provided on the outer beam portion and the fixed terminal, characterized by comprising an operating rod engaged with and moving along the outer beam portion, a normally open movable contact made of a resilient metallic material in contact with the operating rod, a normally open fixed contact placed opposing the normally open movable contact and constituting a normally open contact in association with the normally open movable contact, and a reset rod adapted to move in the direction perpendicular to the direction of the movement of the operating rod, wherein the movement of the operating rod caused by the returning movement of the normally closed movable contact shifts the normally open movable contact to contact with the normally open fixed contact, and wherein when the reset rod is moved in the direction perpendicular to the operating rod, the normally open movable contact is returned to the original position by the aid of the normally open fixed contact, and at the same time, the returning movement of the normally closed movable contact is caused by returning the operating rod whereby the normally closed contact and the normally open contact are respectively rendered to be in returned conditions.

A preferred embodiment of the present invention will be described with reference to the accompanying drawings.

Figure 1:
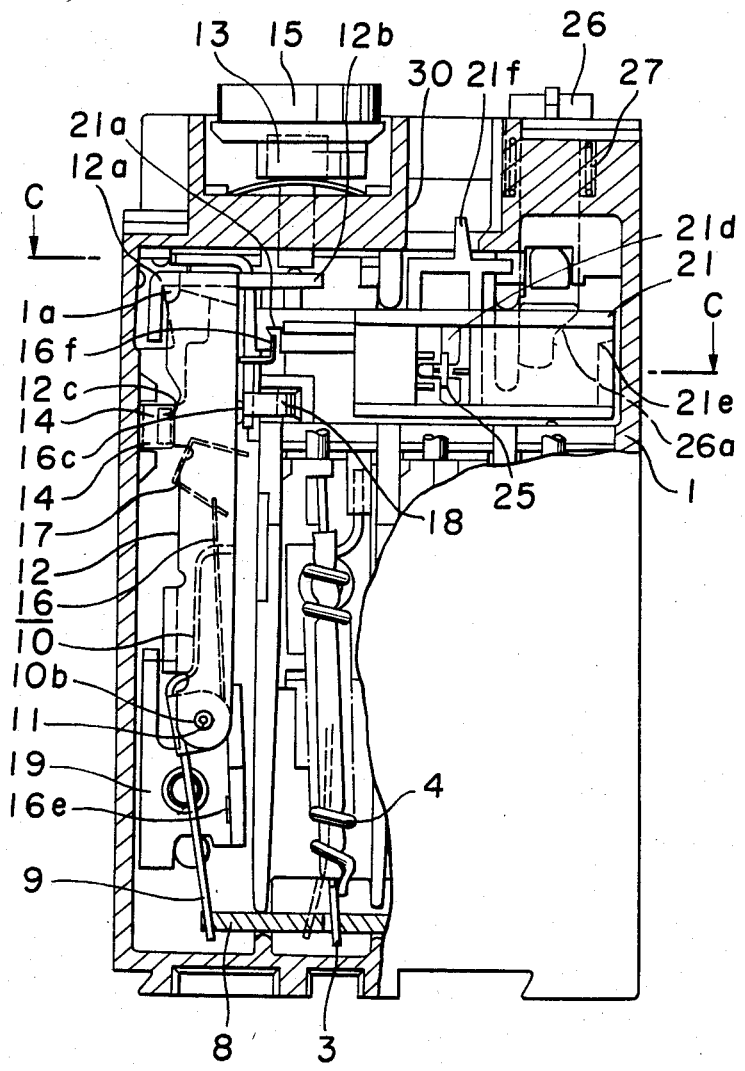
FIGURE 1 PRIOR ART
FIG. 1 is a front view of a prior proposed thermal-type overload relay.
Figure 2:
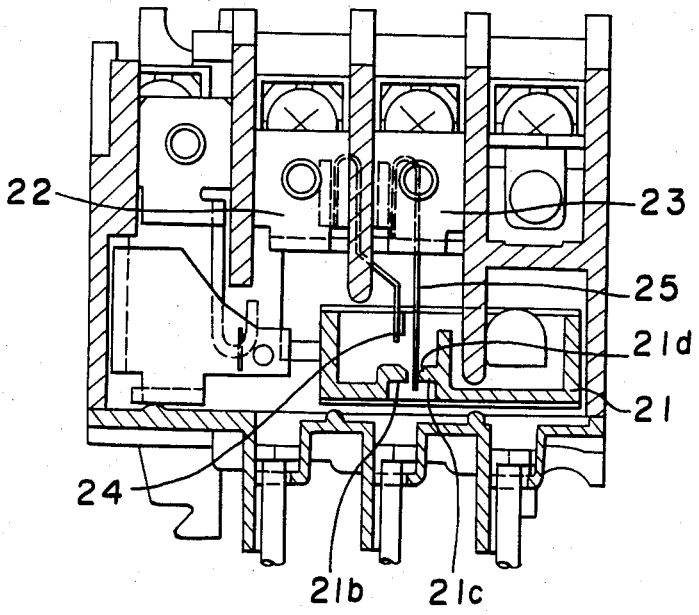
FIGURE 2 PRIOR ART
FIG. 2 is a cross-sectional view taken along a line C—C in FIG. 1.
Figure 3:
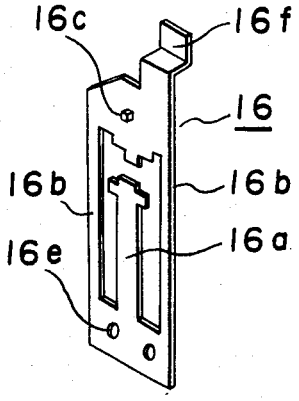
FIG. 3 is a perspective view of a movable contact use for the present invention.
Figure 4:
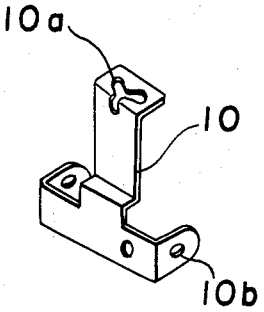
FIG. 4 is a perspective view showing an operating lever used for the present invention.
Figure 5:
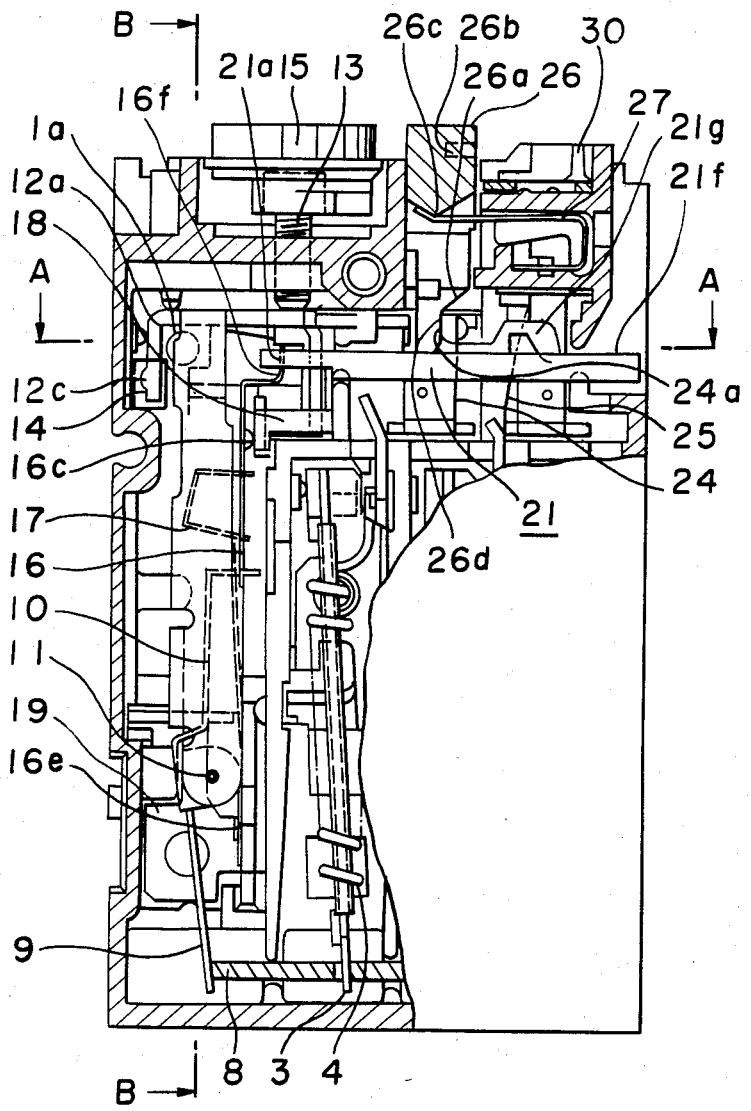
FIG. 5 is a front view of an embodiment of the thermal-type overload relay according to the present invention.
Figure 6:
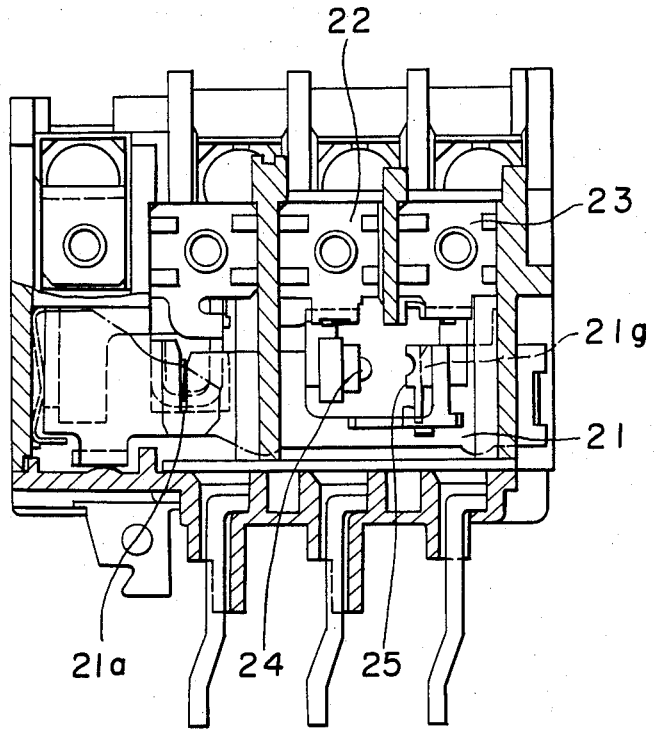
FIG. 6 is a cross-sectional view taken along a line A—A in FIG. 5.
Figure 7:
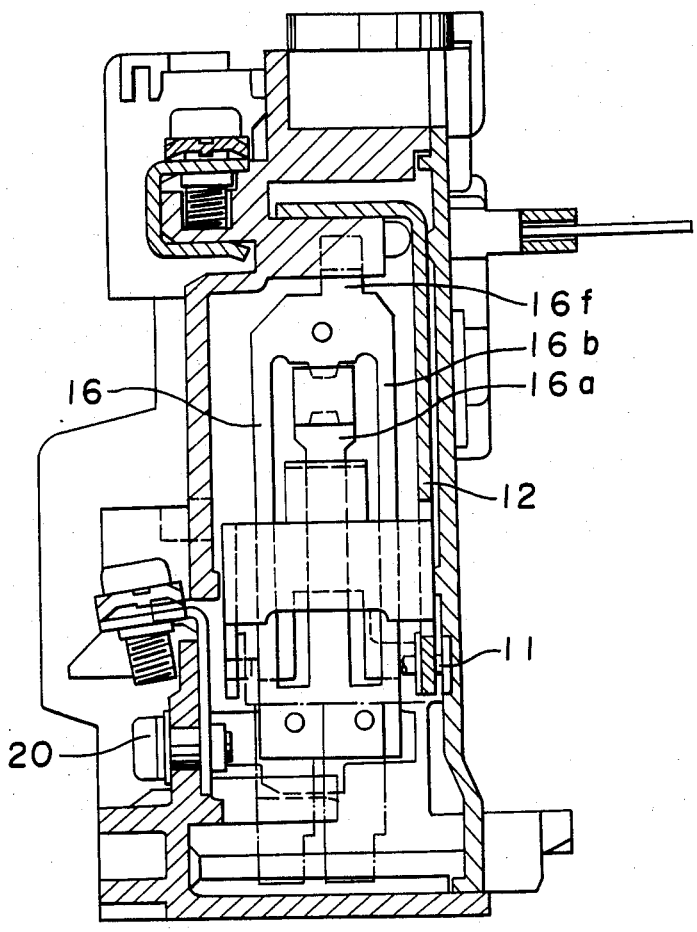
FIG. 7 is a cross-sectional view taken along a line B—B in FIG. 5.
Figure 8:
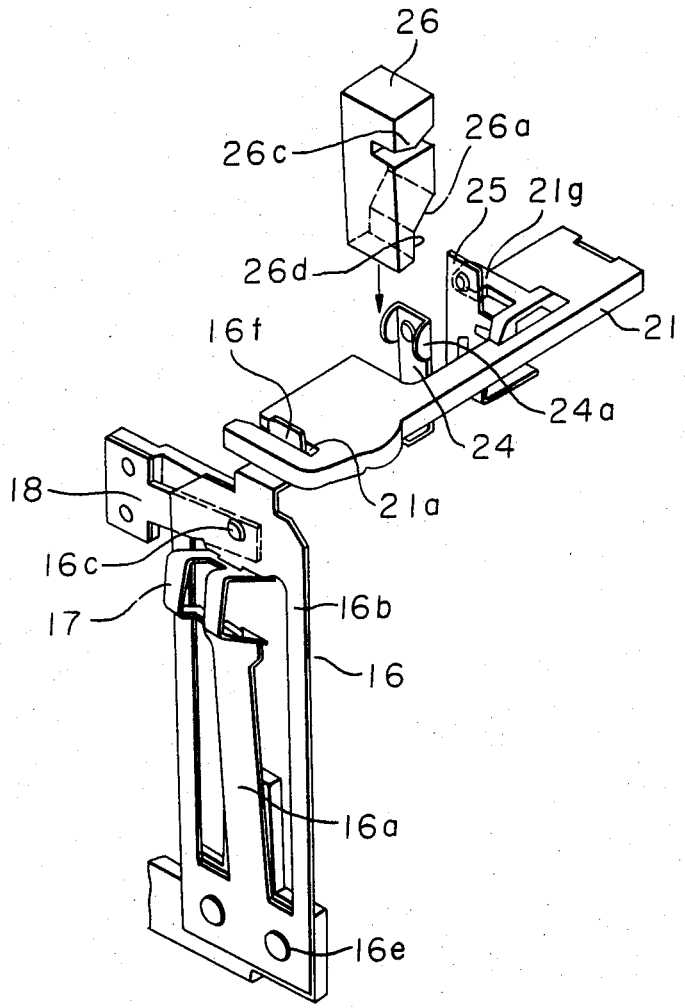
FIG. 8 is a perspective view in a disassembled state of principal elements of the thermal-type overload relay.

In FIGS. 5 to 7 the same reference numerals as in FIGS. 1 to 4 designate the same or corresponding parts and therefore, description of these parts is omitted.

A reference numeral 21 designates an operating rod provided at its left end part with a groove 21*a* with which the upper end portion 16*f* of the outer beam portion 16*b* of the movable contact 16 is engaged. A numeral 22 designates a normally open fixed terminal, a numeral 23 designates a normally open movable terminal, a numeral 24 designates a normally open fixed contact and a numeral 25 designates a normally open movable contact made of a resilient metallic material. The normally open fixed contact 24 and the nomally open movable contact 25 are respectively fixed by cauking to the terminals 22, 23. The normally open movable contact 25 is so arranged that the right side of the rear surface of the end portion contacts with a projection 21*g* of the operating rod 21.

A reference numeral 26 designates a reset rod supported by the housing 1 so as to be vertically slidable. The reset rod has an edge portion 26*c* which receives a pushing force in the upward direction by a returning spring 27, a vertically extending surface portion 26*d* for urging the rear curved portion 24*a* of the normally open fixed contact 24, and a slanted surface 26*a*. The slanted surface 26*a* acts on the normally open fixed contact so that the curved portion 24*a* is moved in the right direction when the reset rod 26 is depressed. A reference numeral 26*b* designates a hole for engagement formed in the reset rod 26. If the thermal-type overload relay is charged into an automatic returning type one, the returning movement of the reset rod 26 in the upper direction is rocked by depressing the reset rod 26 followed by sliding a slide plate 30 in the left direction in FIG. 5 to insert the slide plate 30 into the hole for engagement 26*d*.

The operation of the thermal-type overload relay of the present invention will be described.

When an induction motor becomes an overload state, a main circuit current increases and the temperature of the heater 4 increases. Deformation of the bimetallic strip 3 causes movement of the temperature compensating bimetallic strip 9 by the aid of the shifter 8 whereby the operating lever 10 is turned clockwisely. Then, the inner beam portion 16*a* of the movable contact 16 snaps on the right hand and the outer beam portion 16*b* snaps on the left hand whereby the normally closed contact is opened, and at the same time, the operating rod 21 is moved in the leftward direction in FIG. 5 because it is pulled by the upper end portion 16*f* of the outer beam portion. Displacement of the operating rod 21 shifts the normally open movable contact 25 in the leftward direction which is engaged with the projection 21*g* to be brought into contact with the nomally open fixed contact 24. The operating rod 21 is stopped at the contacting position; thus, the normally open contact is closed. In this case, a sufficient contact pressure is provided to the normally open contact because the pressure of the ⊏-shaped plate spring 17 is applied to the normally open contact by means of the movable contact 16 and the operating rod 21.

For returning operation of the overload relay of the present invention, when the reset rod 26 is manually depressed against the spring action of the returning spring 27, the rear curved portion 24*a* of the normally open fixed contact 24 is urged rightwardly by the slanted surface 26*a* with the consequence that the projection 21*g* of the operating rod 21 is pushed rightwardly by means of the normally open movable contact 25 which has been in contact with the normally open fixed contact 24 thereby causing displacement of the upper end portion 16*f* of the movable conatct 16 in the rightward direction. When the movable contact 16 passes a returning point, it is rapidly returned to the original state, and the returning operation is finished.

When an automatic returning system is employed for the overload relay, the operating rod 21 is shifted on the left hand until the normally open movable contact 25 comes in contact with the normally open fixed contact 24. In this case, the contact pressure is given by a spring force of the plate spring 17.

In accordance with the present invention, a stroke of the operating rod is determined by a position of contact of the normally open contact, and a contact pressure in the normally open contact is provided by a spring action of the plate spring. Accodingly, there is obtainable a thermal-type overload relay having a highly reliable normally open contact by increasing a contact pressure of the contact.

I claim:

1. A thermal-type overload relay comprising a bimetallic strip to be bent to a predetermined position due to heat caused by an excessive amount of current, a normally closed movable contact made of a thin resilient metal plate and having an inner beam portion and an outer beam portion, a pushing plate spring placed across said inner and outer beam portions, and a fixed terminal opposing said normally closed movable contact, in which said normally closed contact undergoes a returning movement by transmitting the movement of said bimetallic strip to said inner beam portion to thereby open a normally closed contact comprising a contact portion provided on said outer beam portion and said fixed terminal, characterized by comprising an operating rod engaged with and moving along said outer beam portion, a normally open movable contact made of a resilient metallic material in contact with said operating rod, a normally open fixed contact placed opposing said normally open movable contact and constituting a normally open contact in association with said normally open movable contact, and a reset rod adapted to move in the direction perpendicular to the direction of the movement of said operating rod, wherein the movement of said operating rod caused by the returning movement of said normally closed movable contact shifts said normally open movable contact to contact with said normally open fixed contact, and wherein when said reset rod is moved in the direction perpendicular to said operating rod, said normally open movable contact is returned to the original position by the aid of said normally open fixed contact, and at the same time, the returning movement of said normally closed movable contact is caused by returning said operating rod whereby said normally closed contact and said normally open contact are respectively rendered to be in returned conditions.

2. A thermal-type overload relay according to claim 1, wherein one end of said normally closed movable contact is fixed; said inner beam portion extends from the fixed end side to other free end side of said normally closed movable contact; and said free end of the outer beam portion is engaged with an end of said operating rod.

3. A thermal-type overload relay according to claim 1, wherein said reset rod is provided with a slanted surface which is in contact with the rear surface of said normally open fixed contact to urge said normally open fixed contact toward said normally open movable contact.

4. A thermal-type overload relay according to claim 1, wherein said operating rod is provided with a groove with which said outer beam portion of the normally closed movable contact is engaged and a projection for pressing said normally open movable contact to cause the movement of the same.

* * * * *